US007808474B2

(12) United States Patent
Mizuno et al.

(10) Patent No.: US 7,808,474 B2
(45) Date of Patent: Oct. 5, 2010

(54) LIGHT CONTROL CIRCUIT AND A LIQUID-CRYSTAL-DISPLAY CONTROL DRIVE DEVICE

(75) Inventors: Toshio Mizuno, Nanae (JP); Takesada Akiba, Nanae (JP); Kazuo Okado, Tokyo (JP)

(73) Assignee: Renesas Electronics Corporation, Kawasaki-Shi (JP)

( * ) Notice: Subject to any disclaimer, the term of this patent is extended or adjusted under 35 U.S.C. 154(b) by 934 days.

(21) Appl. No.: 11/638,534

(22) Filed: Dec. 14, 2006

(65) Prior Publication Data

US 2007/0171182 A1 Jul. 26, 2007

(30) Foreign Application Priority Data

Jan. 25, 2006 (JP) ..... 2006-016420

(51) Int. Cl.
*G09G 3/36* (2006.01)

(52) U.S. Cl. ..... 345/102; 345/207

(58) Field of Classification Search ..... 345/102, 345/87–104, 204, 690, 207
See application file for complete search history.

(56) References Cited

U.S. PATENT DOCUMENTS 5,854,617 A * 12/1998 Lee et al. ..... 345/102
5,901,181 A * 5/1999 LaGarde ..... 375/317
2002/0093477 A1* 7/2002 Wood ..... 345/89
2003/0043680 A1* 3/2003 Akiba et al. ..... 365/227
2005/0162375 A1* 7/2005 Koay et al. ..... 345/102
2006/0007107 A1* 1/2006 Ferguson ..... 345/102

FOREIGN PATENT DOCUMENTS

JP 9-146073 A 6/1997

OTHER PUBLICATIONS

Chinese Office Action dated Mar. 11, 2010 received in counterpart Chinese application (and English translation thereof).

* cited by examiner

*Primary Examiner*—Stephen G Sherman
(74) *Attorney, Agent, or Firm*—Miles & Stockbridge P.C.

(57) ABSTRACT

A light control circuit that makes it possible to, when the light intensity of the area surrounding a display screen varies in a relatively short time, prevent the brightness of a backlight from being erroneously adjusted as the result of the variation being detected is provided. The light control circuit controls the backlight of a display panel. This light control circuit is provided with functions of performing the following operation: detection signals from multiple optical sensors are taken into a common sampling means in a time division manner to acquire multiple sampling values temporally dispersed; a surrounding light intensity is determined by majority decision based on the multiple sampling values, and the result of determination is externally outputted.

11 Claims, 8 Drawing Sheets

LIGHT CONTROL CIRCUIT AND A LIQUID-CRYSTAL-DISPLAY CONTROL DRIVE DEVICE

CROSS-REFERENCE TO RELATED APPLICATION

The present application claims priority from Japanese Patent Application No. 2006-16420 filed on Jan. 25, 2006, the content of which is hereby incorporated by reference into this application.

BACKGROUND OF THE INVENTION

The present invention relates to a technology effectively applicable to a light control circuit capable of controlling the luminance of the backlight of a display panel. Further, it relates to a technology effectively applicable to, for example, a semiconductor integrated circuit for controlling the backlight of a display unit using a transmissive or semi-transmissive liquid crystal display panel or a liquid-crystal-display control drive device constructed as a semiconductor integrated circuit, that drives a liquid crystal display panel.

As a display unit for portable electronic equipment such as cellular phones and PDAs (Personal Digital Assistants), transmissive or semi-transmissive liquid crystal display panels having a backlight on their rear face have been used in these years. Such equipment is mounted in it with a display control unit (liquid crystal controller) constructed as a semiconductor integrated circuit, that controls display in the liquid crystal display panel, a driver that drives the liquid crystal display panel, a driver that drives the backlight, and a controller that controls the luminance of the backlight.

It is known that the viewability of the display in a liquid crystal display panel is caused to greatly fluctuate by ambient brightness. Portable electronic equipment such as cellular phones is used in environments largely different in ambient brightness, for example, indoors and outdoors. Therefore, the brightness of the backlight of a transmissive or semi-transmissive liquid crystal display panel used in these equipment is adjusted according to ambient brightness in some cases. Examples of invention associated with the adjustment of the brightness of the backlight of a liquid crystal display panel include that disclosed in Japanese Unexamined Patent Publication No. Hei 9 (1997)-146073.

SUMMARY OF THE INVENTION

The light control device for backlights, disclosed in Japanese Unexamined Patent Publication No. Hei 9 (1997)-146073, is so constructed that: it is provided with multiple optical sensors for detecting ambient brightness and an average computing means that averages the detection signals of these optical sensors; and the brightness of the backlight is automatically adjusted based on the computed average value of surrounding light intensity and a set value for light control manually set. In this prior invention, the detection signals of the multiple optical sensors are inputted in a time division manner to common amplifier circuit and A-D converter circuit; therefore, the chip size can be reduced when the light control device is constructed as a semiconductor integrated circuit. Further, in this prior invention, the computation of average values of the detection signals of the multiple optical sensors is carried out by software processing according to a program in CPU.

The reason why the detection signals of the multiple optical sensors are averaged is to prevent the brightness of the backlight from being adjusted based on local change in light intensity in part of a display screen. In the prior invention disclosed in Japanese Unexamined Patent Publication No. Hei 9 (1997)-146073, computation of average values is carried out by software processing for this purpose. Therefore, it is supposed that the processing for the detection of surrounding light intensity in the prior invention is carried out in too short a time for humans to perceive change in light intensity.

For this reason, some problems can arise when the technique to adjust the brightness of a backlight of the prior invention is applied. When the light intensity in the area surrounding a display screen varies in a relatively short time, there is the possibility that an optical sensor detects this change in light intensity and the brightness of its backlight is erroneously adjusted. If at all the circuit for adjusting the brightness of a backlight of the prior invention is constructed as a semiconductor integrated circuit, its chip size is increased because it includes CPU; as a result, it is difficult to reduce the size and cost of equipment.

An object of the invention is to provide a light control circuit that, when the light intensity of the area surrounding a display panel varies in a relatively short time, capable of preventing the brightness of a backlight from being erroneously adjusted as the result of that change being detected.

Another object of the invention is to provide a light control circuit that is low in power consumption and is suitable for incorporation in portable electronic equipment, and further makes it possible to reduce the chip size and cost when it is constructed as a semiconductor integrated circuit.

A further object of the invention is to provide a liquid-crystal-display control drive device that is suitable for reducing a number of components to reduce the size of equipment, and is low in power consumption and is suitable for incorporation in portable electronic equipment.

The above and further objects and novel features of the invention will be apparent from the description in this specification and accompanying drawings.

The following is a brief description of the gist of the representative elements of the invention laid open in this application.

A light control circuit that controls the backlight of a display panel is provided with a function of: taking detection signals from multiple optical sensors into a common sampling unit in a time division manner to acquire multiple sampling values temporally dispersed; determining a surrounding light intensity by majority decision based on the multiple sampling values; and externally outputting the result of the determination.

In the above-mentioned light control circuit, detection signals from multiple optical sensors are sampled by taking them into a common sampling unit in a time division manner. Therefore, the space for circuitry can be reduced. Further, the operation of the sampling unit and a determination circuit can be stopped during periods other than periods for which detection signals form the optical sensors are sampled in a time division manner, and thus a power consumption can be reduced. Since multiple sampling values temporally dispersed are acquired in determination, the following advantages are brought: the influence of temporary change in the intensity of surrounding light, such as the noise of ambient light and fluctuation of incident light, is eliminated by temporal filter effect, and a correct surrounding light intensity can be detected.

Sampling values taken in a time division manner are discriminated by multiple threshold voltages using a comparator with a reference voltage switched, and determination by majority decision is made at a logic circuit. The levels of detection signals from optical sensors can be determined at CPU after the signals are converted into digital values through an A-D converter circuit, as in the prior invention. However, when they are determined by a comparator and a logic circuit, the result of determination can be obtained through simple circuitry. In cases where CPU is internally provided, the burden on the CPU can be lessened.

In cases where current output optical sensors are used, an integrator circuit is used for the sampling unit. Optical sensors include MOS sensors composed of MOSFET whose resistance varies depending on the intensity of light applied to their gate electrode section. There is a technology in which MOSFET to be a sensor is formed over the glass substrate of a TFT liquid crystal display panel. In MOS sensors, change in resistance can be easily taken out as change in current. Application of these technologies obviates necessity for use of discrete optical sensors, and makes it possible to realize a small-sized, low-cost display unit with a reduced number of components.

Methods for externally outputting the result of determination of surrounding light intensity include: a method in which information that represents detected surrounding light intensity is outputted; and a method in which a current to be passed through a backlight is outputted according to detected surrounding light intensity. In cases where the method in which a current is outputted is adopted, the brightness of a backlight can be controlled without depending on a control circuit for the backlight.

The following is a brief description of the gist of the effects obtained by the representative elements of the invention laid open in this application.

According to the invention, the following can be implemented when the light intensity of the area surrounding a display screen varies in a relatively short time: the brightness of a backlight can be prevented from being erroneously adjusted as the result of that change being detected. Further, a light control circuit that is low in power consumption and is suitable for incorporation in portable electronic equipment, and makes it possible to reduce the chip size and cost when it is constructed as a semiconductor integrated circuit can be realized.

Further, according to the invention, a liquid-crystal-display control drive device that is suitable for reducing a number of components and the size of equipment, and is low in power consumption and is suitable for incorporation in portable electronic equipment can be realized.

DETAILED DESCRIPTION OF THE PREFERRED EMBODIMENTS

Hereafter, description will be given to a preferred embodiment of the invention.

Figure 1:
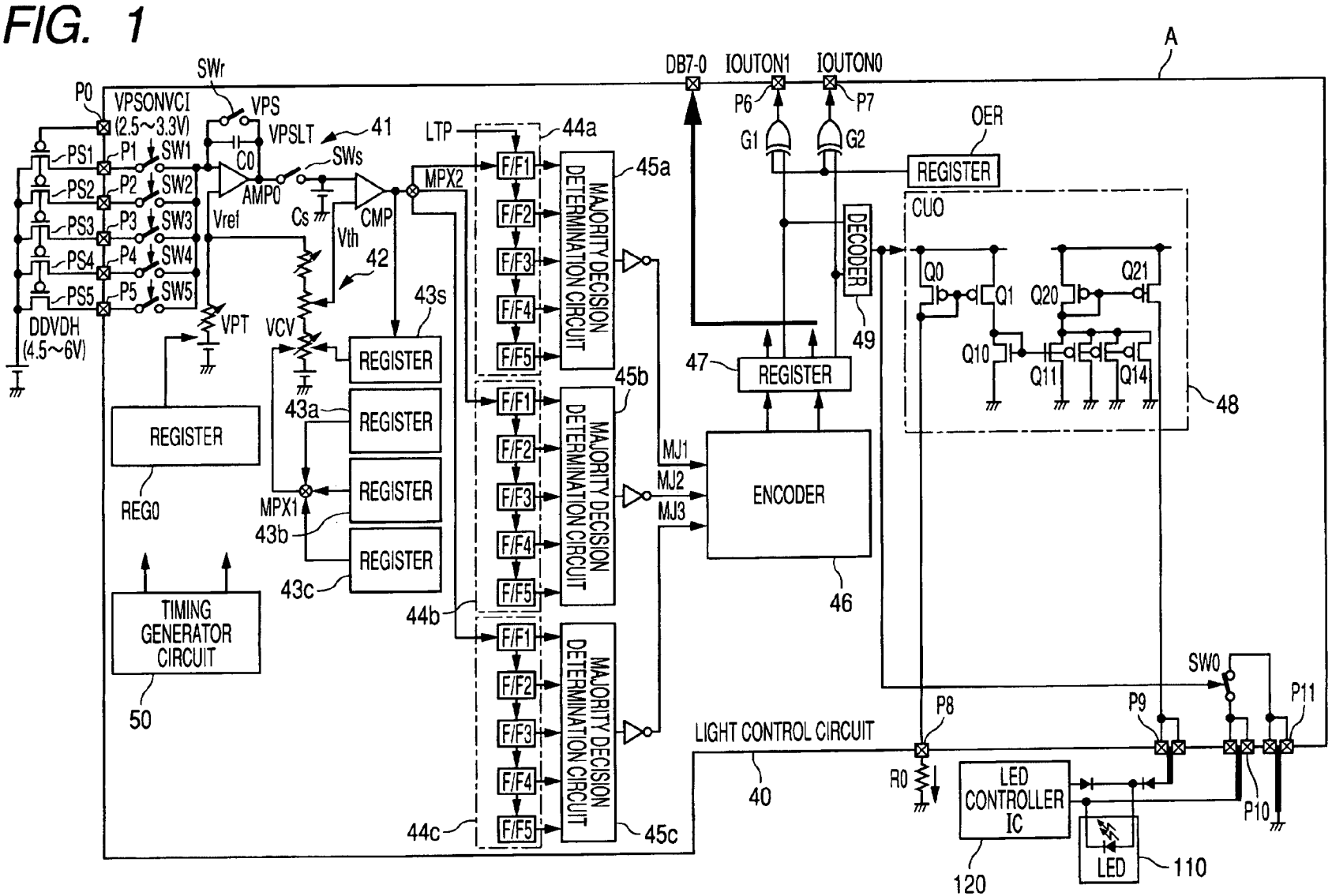
FIG. 1 is a block diagram illustrating the overall configuration of a light control circuit provided with a function of detecting the light intensity of a liquid crystal display unit and a backlight control function, according to the invention.

FIG. 1 is a block diagram illustrating the overall configuration of a light control circuit provided with a function of detecting the light intensity of the area surrounding a liquid crystal display unit and a backlight control function, according to the invention. The portion encircled with solid line A is constructed as a semiconductor integrated circuit over a single semiconductor substrate of single crystal silicon or the like.

Figure 5:
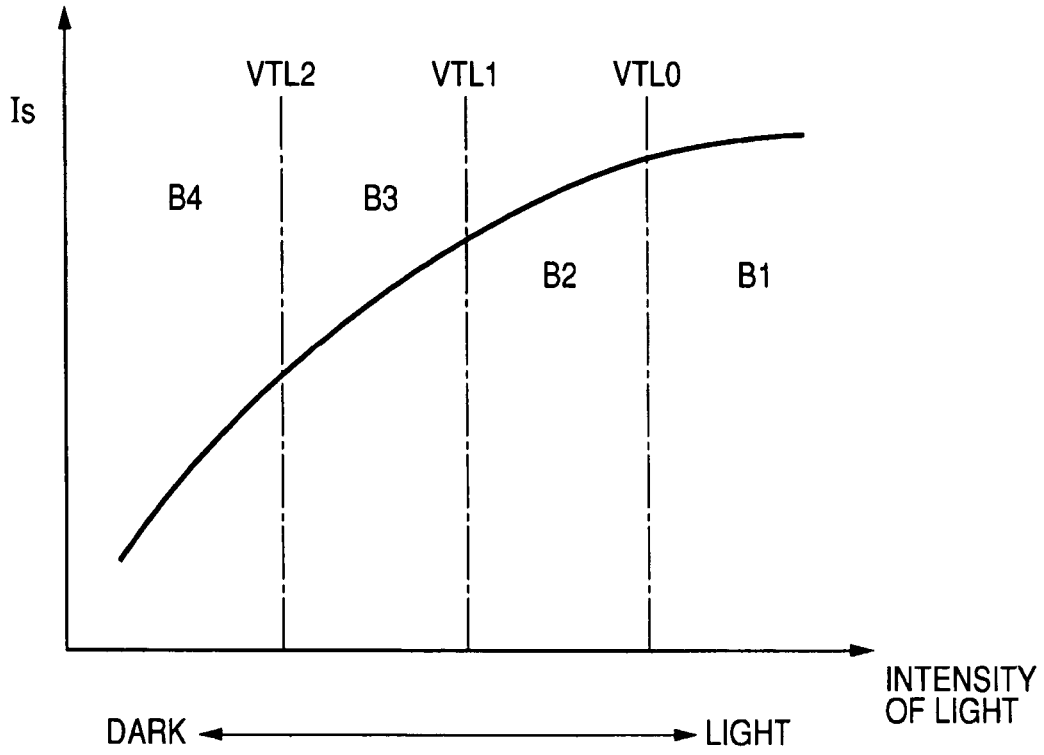
FIG. 5 is a characteristic diagram that indicates the characteristics of an optical sensor used in a backlight control circuit in an embodiment.

The light control circuit 40 in this embodiment includes: external input terminals (pads) P1 to P5 to which the source (or drain) terminals of light detecting elements (MOS sensors) PS1 to PS5 as optical sensors composed of MOSFETs; and an external output terminal P0 that is connected to the gate terminals of the MOS sensors PS1 to PS5 and applies a predetermined bias voltage. The MOS sensors PS1 to PS5 used in this embodiment are elements having such characteristics that the following takes place when light is applied to them with a predetermined bias voltage applied to their gate terminals and drain (or source) terminals: the current Is passed between their drain and source varies depending on the intensity of the applied light, as indicated in FIG. 5. In this embodiment, a voltage VPSONVCI of 2.5 to 3.3V outputted through the external output terminal P0 is applied to the gate terminals of the MOS sensors PS1 to PS5, and a voltage DDVDH of 4.5 to 6.0V from an external voltage source is applied to their drain (or source) terminals though the invention is not specially limited to this construction.

The light control circuit 40 includes an integrator circuit 41 that integrates the currents flowing from the MOS sensors PS1 to PS5 through the terminals P1 to P5 and thereby samples the voltage corresponding to the light intensity incident on each sensor. Further, the light control circuit includes: a comparator CMP that discriminates the voltages sampled by this integrator circuit 41 by a predetermined threshold voltage; a resistance type voltage divider circuit 42 that supplies a reference voltage Vth as the threshold voltage of the comparator CMP; and registers 43*a*, 43*b*, and 43*c* that specify the level of the reference voltage.

Further, the light control circuit includes a register 43*s* that is so constructed that it shifts the reference level supplied to the comparator CMP to provide it with hysteresis characteristics and sets the amount of shift when a reference level is shifted. In the stage subsequent to the comparator CMP, there are provided three sets of shift registers 44*a*, 44*b*, and 44*c* that each sequentially hold up to five results of comparison by the comparator, majority decision determination circuits 45*a*, 45*b*, and 45*c* that determines the majority of the comparison results held in these shift registers; and an encoder 46 that encodes the outputs of the three majority decision determination circuits.

The above-mentioned light control circuit 40 includes: a register 47 that holds the results of encoding by the encoder 46; a current source circuit 48 that passes current through a light emitting diode 110 as a backlight; and a decoder 49 that decodes the values held in the register 47 to generate on/off signals for the current source circuit 48. Further, the light control circuit 40 includes a timing generator circuit 50 that generates signals for sequentially activating the above-mentioned individual circuits and switches with predetermined timing.

Further, the light control circuit 40 includes: external output terminals P6 and P7 for outputting the values held in the register 47 to outside the chip; gates G1 and G2 that are provided between the register 47 and the external output terminals P6 and P7 and are used to permit and interrupt the output of signals; and an output enable register OER that holds control codes for the gates G1 and G2. The register 47 is so constructed that an external microprocessor (MPU) can read from the register through a data bus according to a status read command.

The integrator circuit 41 is constructed of: Op Amp (operational amplifier) AMP0; an integral capacitance C0 connected between the inverting input terminal and output terminal of the Op Amp; a reset switch SWr provided in parallel with the capacitance C0; a sampling switch SWs and a sampling capacitance Cs connected between the output terminal of the amplifier AMP0 and a ground point; and the like.

Further, the integrator circuit 41 includes a reference voltage source VPT connected between the non-inverting input terminal of the amplifier AMP0 and a ground point; a register REG0 that specifies a reference voltage Vref to be supplied to the amplifier AMP0 by the reference voltage source VPT; and the like. At the same time, between the inverting input terminal of the amplifier AMP0 and the external input terminals P1 to P5 to which the MOS sensors PS1 to PS5 are connected, there are provided selector switches SW1 to SW5 that allow currents to be sequentially inputted from the sensors to the integrator circuit 41 so that the integrator circuit can carry out integration in a time division manner.

Table 1 below shows an example of the relation between values set on the register REG0 and the levels of reference voltage Vref supplied to the amplifier AMP0 by the reference voltage source VPT according to these set values. The source-drain voltages of the sensors when integration is started can be varied to vary the value of input current to the integrator circuit 41 by varying the reference voltage Vref supplied to the amplifier AMP0 according to the set value on the register REG0. This makes it possible to adjust the slope of the output waveform of the integrator circuit, indicated at the lowermost part of the FIG. 2. As a result, the detection sensitivity of the sensors can be adjusted.

TABLE 1

| VPT1 | VPT0 | Vref |
|---|---|---|
| 0 | 0 | 2.0 V |
| 0 | 1 | 2.1 V |
| 1 | 0 | 2.2 V |
| 1 | 1 | 2.3 V |

On the input side of the comparator CMP, there are provided a resistance type voltage divider circuit 42 that supplies the comparator CMP with a reference voltage Vth corresponding to a specified value supplied from the registers 43*a*, 43*b*, and 43*c*, and a multiplexer MPX1 that sequentially supplies the values on the registers 43*a*, 43*b*, and 43*c* to a variable constant-voltage source VCV. On the output side of the comparator CMP, there is provided a multiplexer MPX2 for sequentially supplying the output of the comparator CMP to the shift registers 44*a*, 44*b*, and 44*c*. The multiplexers MPX1 and MPX2 are controlled in synchronization with each other according to operation clocks of the same periodicity supplied from the timing generator circuit 50.

Tables 2 to 4 indicate examples of the relation between values set on the registers 44*a*, 44*b*, and 44*c* and the levels of reference voltage Vth to be supplied to the comparator CMP by the resistance type voltage divider circuit 42 according to these set values.

TABLE 2

| VPL22 | VPL21 | VPL20 | Vth |
|---|---|---|---|
| 0 | 0 | 0 | 2.0 V |
| 0 | 0 | 1 | 1.9 V |
| 0 | 1 | 0 | 1.8 V |
| 0 | 1 | 1 | 1.7 V |
| 1 | 0 | 0 | 1.6 V |
| 1 | 0 | 1 | 1.5 V |
| 1 | 1 | 0 | 1.4 V |
| 1 | 1 | 1 | 1.3 V |

TABLE 3

| VPL12 | VPL11 | VPL10 | Vth |
|---|---|---|---|
| 0 | 0 | 0 | 1.8 V |
| 0 | 0 | 1 | 1.7 V |
| 0 | 1 | 0 | 1.6 V |
| 0 | 1 | 1 | 1.5 V |
| 1 | 0 | 0 | 1.4 V |
| 1 | 0 | 1 | 1.3 V |
| 1 | 1 | 0 | 1.2 V |
| 1 | 1 | 1 | 1.1 V |

TABLE 4

| VPL02 | VPL01 | VPL00 | Vth |
|---|---|---|---|
| 0 | 0 | 0 | 1.2 V |
| 0 | 0 | 1 | 1.1 V |
| 0 | 1 | 0 | 1.0 V |
| 0 | 1 | 1 | 0.9 V |
| 1 | 0 | 0 | 0.8 V |
| 1 | 0 | 1 | 0.7 V |
| 1 | 1 | 0 | 0.6 V |
| 1 | 1 | 1 | 0.5 V |

Figure 2:
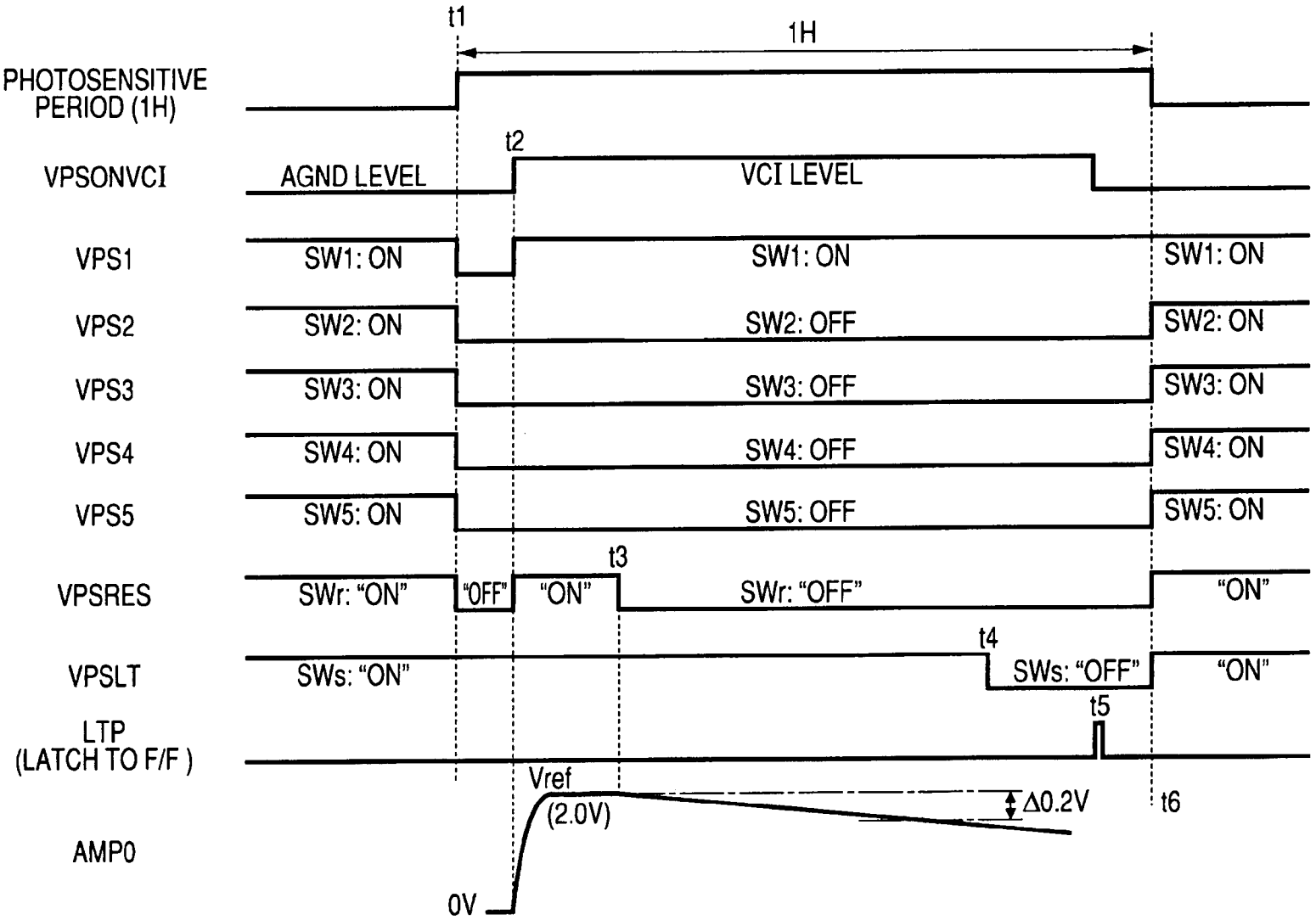
FIG. 2 is a timing diagram that explains the integrating operation of an integrator circuit that constructs a backlight control circuit in an embodiment.

Description will be given to the integrating operation performed by the integrator circuit 41 with reference to the timing diagram in FIG. 2. In FIG. 2, reference code VPSONVCI denotes voltage applied to the gate electrodes of the MOS sensors PS1 to PS5; VPS1 to VPS5 denote control signals for the switches SW1 to SW5 for time division input; and VPSRES denotes a control signal for the reset switch SWr in parallel with the integral capacitance C0. Reference code VPSLT denotes a control signal for the sampling switch SWs on the output side of the amplifier AMP0 in the integrator circuit; and LTP denotes a pulse that supplies latch timing to the initial-stage flip-flops of the shift registers 44*a*, 44*b*, and 44*c*.

When integrating operation is started, VPS1 to VPS5 and VPSRES are caused to transition to the low level, and all the switches SW1 to SW5 for time division input and the reset switch SWr are turned off (time t1). At this time, the voltage VPSONVCI applied to the gate electrodes of the sensors PS1 to PS5 is 0V and the sampling switch SWs is on. This zeroes the output voltage of the amplifier AMP0 in the integrator circuit.

Subsequently, the switch (SW1 in the drawing) of the switches SW1 to SW5 for time division input, connected with any one of the sensors and the reset switch SWr are turned on (time t2). This increases the output voltage of the amplifier AMP0 to the reference voltage Vref (e.g., 2.0V) in a stroke. At the same time, the voltage VPSONVCI applied to the gate electrodes of the sensors PS1 to PS5 is changed to such a sensor activation voltage as 2.5 to 3.3V.

Thereafter, the reset switch SWr is turned off (time t3). The sampling switch SWs remains on. Thus, the integral capacitance C0 is charged with the current inputted from the sensor PS1 and starts integration, and the output voltage of the amplifier AMP0 starts to gradually lower in conjunction therewith. When the signal VPSLT is caused to transition to the low level and the sampling switch SWs is turned off, the immediately preceding output voltage of the amplifier AMPO is held in the sampling capacitance Cs (time t4).

The voltage held in the sampling capacitance Cs is compared with the reference voltage Vth as a threshold voltage by the comparator CMP. In cases where the output voltage of the amplifier AMP0 is lower than the reference voltage Vth at this time, the output of the comparator CMP transitions to the high level. In cases where the output voltage of the amplifier is higher than the reference voltage Vth, it remains at the low level. The output (comparison result) of the comparator CMP is latched to the initial-stage flip-flop of any of the shift registers 44*a*, 44*b*, and 44*c* through the multiplexer MPX2 by the latch pulse LTP (time t5).

Figure 6:
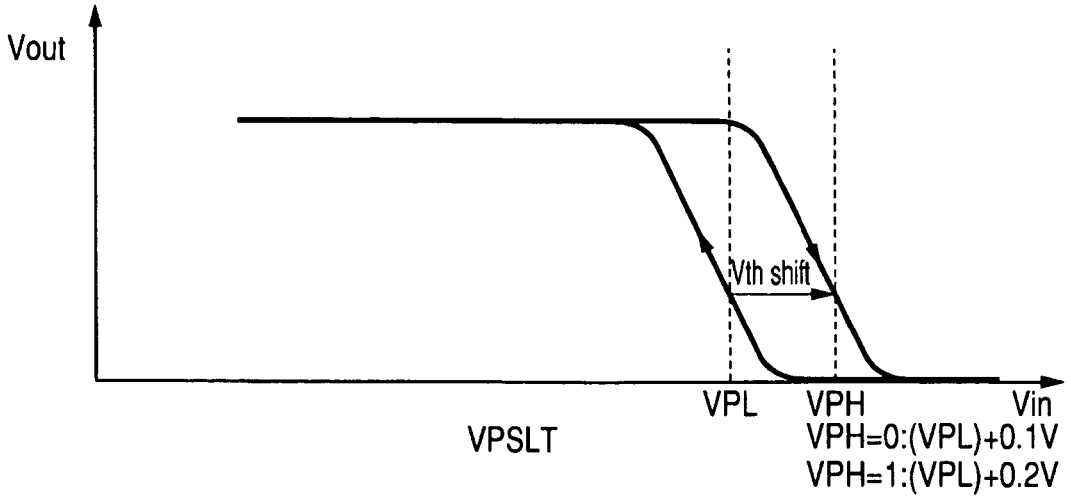
FIG. 6 is an input/output characteristic diagram that explains the hysteresis characteristics of a comparator that constructs a backlight control circuit in an embodiment.

The comparator CMP is so constructed that it is provided with such hysteresis characteristics as illustrated in FIG. 6 by the reference voltage Vth applied to its input terminal. Specifically, the comparator CMP is so constructed that the following takes place when its output transitions to the high level: the reference voltage Vth supplied from the resistance type voltage divider circuit 42 shifts from the lower threshold voltage VPL to the higher threshold voltage VPH. Thus, even when noise is superimposed on the output of the amplifier AMP0, the output of the comparator CMP does not react to that noise. In this embodiment, furthermore, the potential difference between VPL and VPH, that is, the width of hysteresis, can be varied by setting it to either 0.1V or 0.2V, for example, by the set value on the register 43*s*.

Description will be given to the operation of the comparator CMP and the majority decision determination circuits 45*a* to 45*c* performed when the light control circuit 40 illustrated in FIG. 1 is applied to a backlight control circuit for a liquid crystal display panel with reference to the timing diagrams in FIG. 3 and FIG. 4. In FIG. 4, reference code FLM denotes a signal indicating a period for which one screen page is displayed (so-called one frame); and VCOM denotes common voltage applied to a common electrode opposed to each picture electrode of the liquid crystal display panel. The upper half of the diagram indicates the timing during line alternating current driving during which the polarity is inverted on a line-by-line basis; the lower half of the diagram indicates the timing during frame alternating current driving during which the polarity is inverted on a frame-by-frame basis.

Figure 3:
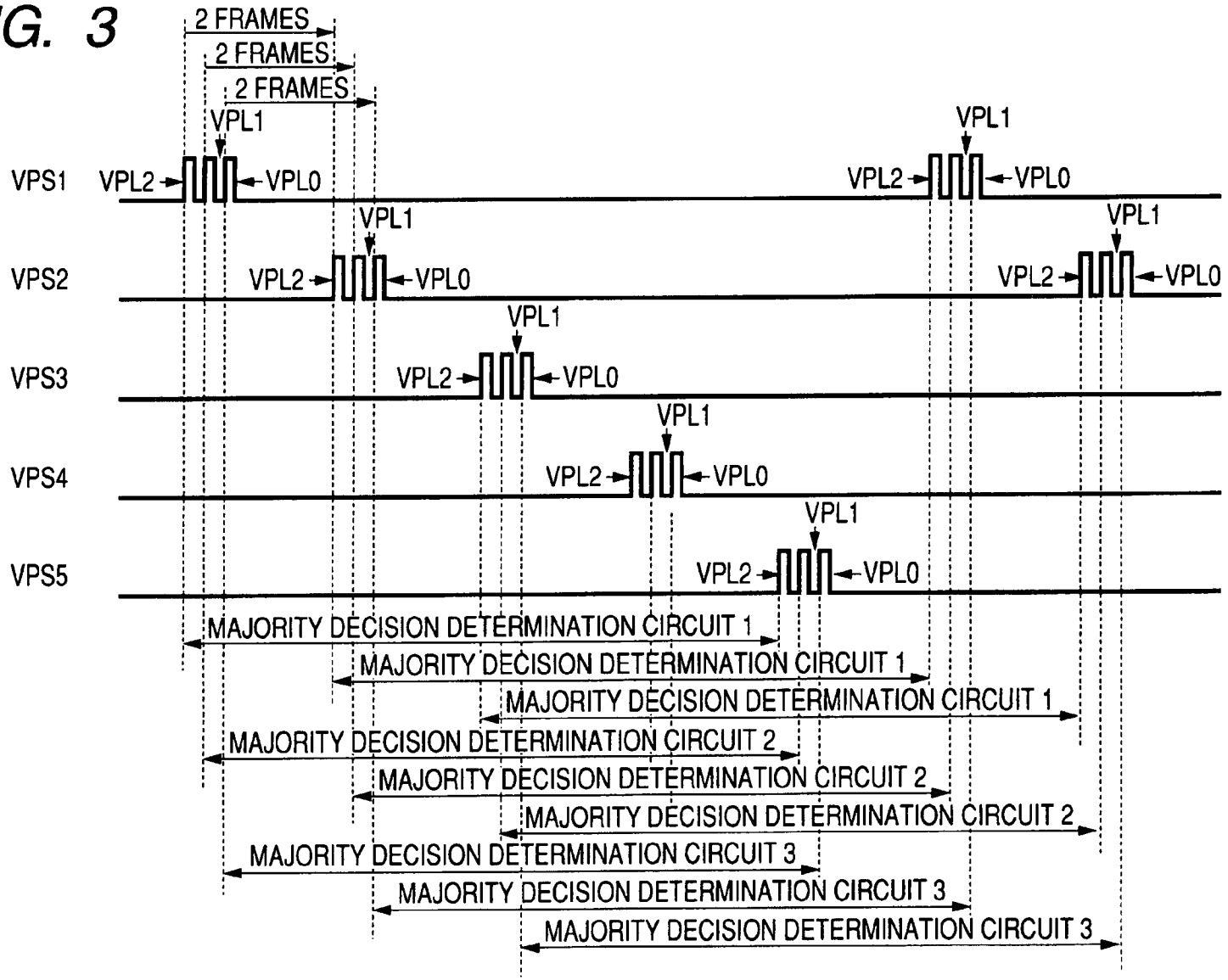
FIG. 3 is a timing diagram that explains the determination by majority decision of the outputs of optical sensors in a backlight control circuit in an embodiment.
Figure 4:
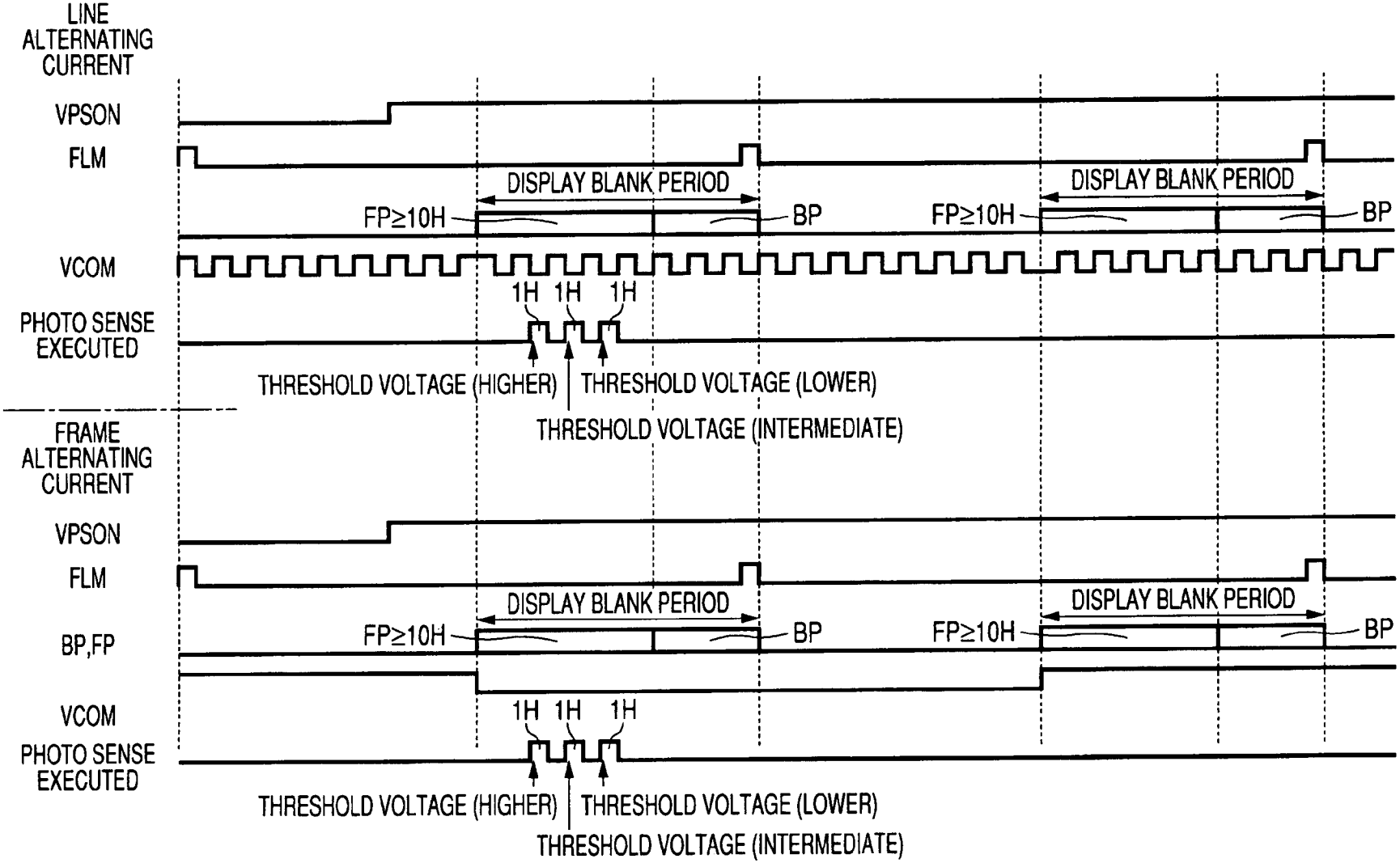
FIG. 4 is a timing diagram indicating the timing with which the outputs of optical sensors are sampled in a backlight control circuit of an embodiment.

In this embodiment, as illustrated in FIG. 3, the switches SW1 to SW5 for time division input are sequentially on/off-controlled by the control signals VPS1 to VPS5. The MOS sensor as the object of detection is changed three times for two frames, and the outputs of the sensors are sampled. The values taken in by three consecutive times of sampling operation are related to one and the same sensor. In cases where five sensors are used and the frame period is set to 60 to 70 Hz (approximately 14 to 16 mS) as in this embodiment, the output of each sensor is consecutively sampled three times every 0.14 to 0.16 seconds. The period of 1H indicated in FIG. 4 is of the length equivalent to 1/144 of the frame period when the number of the gate lines of the liquid crystal display panel is 128 and the display blank period is 16H.

That is, three consecutive times of sampling with respect to one sensor are carried out at intervals of approximately 0.1 mS, and sampling is carried out at intervals of 20 mS with respect to all the five sensors. The sampling period need not be a period of two frames, and it may be a period of three frames or a period of four frames. However, when the sampling period is too short, backlight control reacts to temporary change in surrounding light intensity; when it is too long, the response of backlight control to change in surrounding light intensity is delayed. Therefore, a sampling period of not longer than one frame or not shorter than 10 frames is undesirable.

The three sampling values consecutively obtained with respect to one and the same sensor are respectively compared with the threshold voltage of the comparator CMP, that is varied from VPL2 to VPL1 to VPL0. Thus, three comparison results are outputted from the comparator CMP, and each comparison result is distributed to the shift registers 44*a*, 44*b*, and 44*c* by the multiplexer MPX2 and latched there.

When the three times of sampling and comparison are completed with respect to the output of the first sensor PS1, three times of sampling and comparison are carried out two frames later with respect to the output of the second sensor PS2. When the three times of sampling and comparison are completed, three times of sampling and comparison are carried out two frames later with respect to the output of the third sensor PS3. Each time a comparison result is obtained with respect to each sensor, the shift registers 44*a*, 44*b*, and 44*c* are caused to perform shift operation, and the comparison result with respect to the previous sensor is shifted to the flip-flops in the next stage.

When three comparison results are obtained with respect to the output of the fifth sensor PS5 as mentioned above, determination by majority decision is carried out by the majority decision determination circuits 45*a* to 45*c*. The following advantage is brought by carrying out determination by majority decision on the five sensor outputs temporally dispersed: in cases where there is fluctuation in light incident on a sensor or incident light temporarily changes, erroneous detection can be prevented by temporal filter effect.

To carry out determination by majority decision on five sensor outputs, the following method could be adopted: five sensor outputs are sampled during one display blank period, and are discriminated with one and the same threshold voltage and the result of discrimination is subjected to determination by majority decision; and five sensor outputs are sampled during the display blank period for the next frame and discriminated with the threshold voltage changed, and the comparison result is subjected to determination by majority decision. However, temporal filter effect cannot be obtained by this method. Therefore, it is desirable to sample five sensor outputs temporally dispersed, as in the above-mentioned embodiment.

In cases where determination by majority decision is carried out before the outputs of the five sensors have not been all obtained, the result of determination by majority decision varies depending on the initial state of each flip-flop that constructs the shift registers 44*a*, 44*b*, and 44*c* immediately after start of control. A proper result of determination can be obtained by waiting until the outputs of the five sensors are all obtained and then carrying out determination by majority decision. The light control circuit in this embodiment is so constructed that it can be selected by setting a predetermined register whether the backlight should be brought into on state or off state until the outputs of the five sensors are all obtained though this is not shown in the drawings.

Once comparison results are obtained with respect to the outputs of the five sensors PS1 to PS5, determination by majority decision is carried out by the majority decision determination circuits 45*a* to 45*c* every two frames. The determination results MJ1 to MJ3 of the majority decision determination circuits 45*a* to 45*c* are encoded into two-bit codes B1 and B2 by the encoder 46 and outputted. Table 5 indicates an example of the relation between the input and output of the encoder 46, that is, the table is an example of a truth table.

TABLE 5

| MJ1 | MJ2 | MJ3 | B1 | B2 |
|---|---|---|---|---|
| L | L | L | 1 | 1 |
| L | L | H | 1 | 0 |
| L | H | H | 0 | 1 |
| H | H | H | 0 | 0 |

Further, this embodiment is so constructed that the following is implemented: during each display blank period called front porch (FP) and back porch (BP) before and after a frame change of one frame period of the liquid crystal display panel, the above-mentioned three consecutive times of sampling and comparison are carried out. During display blank periods, the gate lines of the liquid crystal display panel are not driven. Therefore, the peak current of the IC can be lowered by carrying out sampling and comparing operations during display blank periods. There is another advantage. When the output of a sensor is influenced by light leaking from a display area or a light control circuit and a liquid crystal driver are formed over one and the same semiconductor chip, as described later, the following is implemented: the light control circuit can be prevented from malfunctioning due to noise produced by the passage of large current through the liquid crystal driver circuit.

Further, this embodiment is so constructed that the following is implemented though this is not shown in the drawings: the current sources for the amplifier AMP0 that constructs the integrator circuit 41 and the amplifier that constructs the reference voltage source VPT or the current source for the amplifier that constructs the comparator CMP does not pass current during periods other than display blank periods during which sampling operation is carried out; that is, they do not pass current during normal display periods. Thus, the power consumption during display periods can be reduced.

Description will be given to the current source circuit 48 provided in the light control circuit 40 illustrated in FIG. 1 and circuits associated therewith.

The current source circuit 48 is constructed of three current mirror circuits composed of MOSFETs whose gates are connected in common. More specifically, the current source circuit 48 includes: a first current mirror circuit composed of MOSFETs Q0 and Q1 whose gates are connected in common; and a second current mirror circuit composed of MOSFET Q10 connected in series with the MOSFET Q1 and MOSFETs Q11 to Q14 whose gates are connected in common with the gate of the MOSFET Q10. Further, the current source circuit includes a third current mirror circuit composed of MOSFET Q20 connected in series with the MOSFETs Q11 to Q14 and MOSFET Q21 whose gate is connected in common with the gate of the MOSFET Q20. The drain terminal of the MOSFET Q0 in the first current mirror circuit is connected to an external terminal P8, and the drain terminal of the MOSFET Q21 in the third current mirror circuit is connected to an external terminal P9.

This embodiment is so constructed that the following takes place: when the output of the encoder 46 indicates that the surrounding light intensity is in the region B4 where the intensity is lowest in FIG. 5, the decoder 49 outputs a signal CSon for turning on the current source circuit 48. The current source circuit 48 is so constructed that, when the current source circuit 48 is turned on, it outputs so relatively small a current as 100 to 400 μA (Microampere) to the external terminal P9.

The external terminal P9 is so constructed that a light emitting diode 110 that forms the backlight can be connected thereto as an external element, and, when a minute electric current is passed through the external terminal P9, the light emitting diode 110 lights up with a relatively low brightness. The reason is as follows: when the area surrounding the display panel is dark, the display can be viewed even if the light from the backlight is relatively weak, and the power consumption can be reduced by lowering the brightness of the light emitting diode 110. Provision of the current source circuit 48 makes it possible to realize a simple display unit that does not require a backlight control circuit or a display unit whose backlight can be lighted up without driving a backlight control circuit 12.

In this embodiment, there are provided a ground terminal P11 adjacent to the external terminal P9 and an external terminal P10 with a switch SW0 placed between it and the ground terminal P11. The switch SW0 is so constructed that it is turned on/off in relation to the on/off state of the current source circuit 48 by a signal CSon outputted from the decoder 49 to the current source circuit 48. Specifically, when the signal CSon is at such a level as to turn on the current source circuit 48, the switch SW0 is turned on; when it is at such a level as to turn off the current source circuit 48, the switch SW0 is turned off.

A concomitant system so constructed that the following is implemented is possible: a light emitting diode 110 as a backlight is lighted up by a current outputted from the above-mentioned current source circuit 48 in the light control circuit 40; and further, it can also be lighted up by a backlight control circuit 120 provided separately from the light control circuit 40. In such a system, the light emitting diode 110 cannot be lighted up with the backlight control circuit 120 off even if a current is caused to flow from the external terminal P8 to the light emitting diode. This is because no current is drawn from the cathode of the light emitting diode 110.

Meanwhile, when the current source circuit 48 is started, the switch SW0 is automatically turned on by taking the following measure illustrated in FIG. 1: the cathode terminal of the light emitting diode 110 is connected not only to the backlight control circuit 120 but also to the external terminal P10 of the light control circuit 40. For this reason, a current flowing out of the cathode terminal of the light emitting diode 110 can be caused to flow to the ground terminal P11 through the switch SW0, and the light emitting diode 110 can be thereby lighted up. When the light emitting diode 110 is caused to emit light by a current from the backlight control circuit 120, control is carried out so that a current is not drawn into the light control circuit 40 by turning off the switch SW0.

In the embodiment illustrated in FIG. 1, the external terminal P8 is provided to which the drain terminal of the MOS- FET Q0 that constructs a current mirror in the current source circuit 48 is connected and which is for externally connecting an external resistor R0. This is intended to make it possible to cause a current to flow from the current source circuit 48 to the outside through the external terminal P8.

As is publicly known, it is difficult to form a resistance element having an accurate resistance value over a semiconductor chip with present manufacturing techniques for semiconductor integrated circuits. For this reason, use of an external resistor makes it possible to output a more accurate current than in cases where an on-chip resistor is used. With use of an external resistor, an accurate current can be passed by adjusting the resistance of the connected resistance element even when there is variation in the characteristics of the MOSFET Q0.

Figure 7:
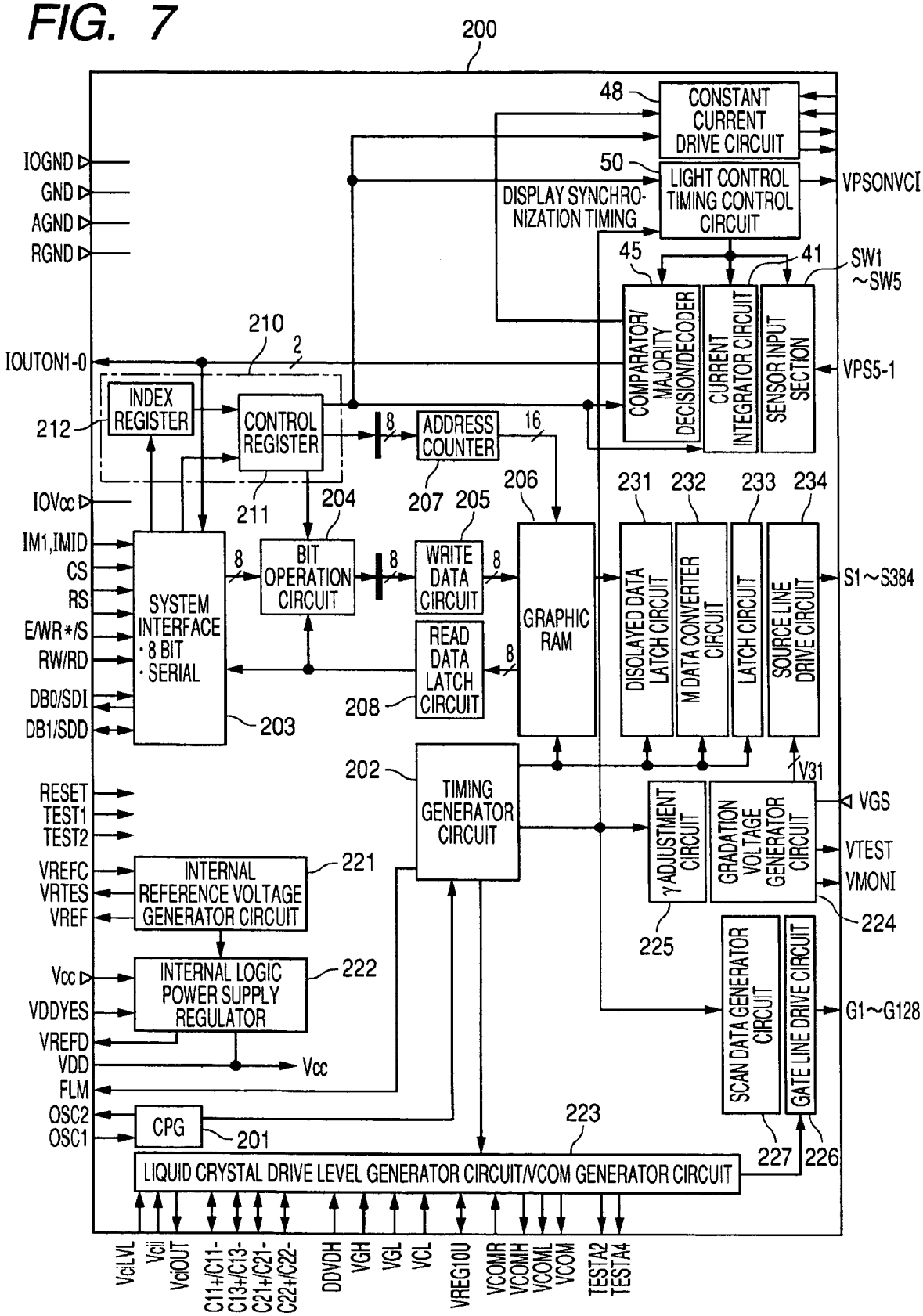
FIG. 7 is a block diagram illustrating an embodiment of a liquid crystal control driver mounted with the light control circuit illustrated in FIG. 1 as a backlight control circuit.

FIG. 7 is a block diagram illustrating an embodiment of a liquid crystal control driver 200 incorporating the light control circuit illustrated in FIG. 1 as the backlight control circuit for the liquid crystal display panel. The liquid crystal control driver 200 is formed as a semiconductor integrated circuit over a single semiconductor substrate.

The liquid crystal control driver 200 includes: a pulse generator 201 that generates a reference clock pulse for an external oscillation signal or internal to the chip; and a timing generator circuit 202 that generates a timing control signal internal to the chip based on this clock pulse. Further, the liquid crystal control driver includes: a system interface 203 for transmitting and receiving commands and data such as static image data to and from an external microprocessor (hereafter, referred to as MPU) through a system bus; and a control unit 210 that controls the entire chip.

Further, the liquid crystal control driver 200 includes: a graphic RAM 206 as display memory that stores displayed data in the bitmap format; an address counter 207 that generates addresses for the graphic RAM 206; and a read data latch circuit 208 that holds data read from the graphic RAM 206. Further, the liquid crystal control driver includes: a logical operation means that carries out logical operation and the like for superposition display based on data read out to the latch circuit 208 and write data supplied from the MPU; a bit shift means for scroll display; and the like. The liquid crystal control driver is provided with a bit operation circuit 204 that performs bit operation on write data and read data. Further, it is provided with a write data circuit 205 that takes in data subjected to bit operation by the bit operation circuit 204 and writes data to the graphic RAM 206.

The control unit 210 includes: a control register 211 for controlling the operating state of the entire chip, such as the operation mode of the liquid crystal control driver 200; an index register 212 that specifies in advance multiple command codes and commands to be executed in the control unit; and the like. The liquid crystal control driver is so constructed that the following is implemented: when the external MPU writes data to the index register 212 to specify a command to be executed, the control unit 210 generates a control signal corresponding to the specified command.

The liquid crystal control driver 200 makes a display on the liquid crystal display panel based on a command from the MPU and data under the control of the thus constructed control unit 210. At this time, the liquid crystal control driver carries out drawing processing to sequentially write displayed data to the graphic RAM 206. In addition, the liquid crystal control driver 200 carries out read processing to periodically read displayed data from the graphic RAM 206, and generates and outputs signals to be applied to the source lines of the liquid crystal display panel.

Further, the liquid crystal control driver 200 in this embodiment is provided with: an internal reference voltage generator circuit 221 that generates internal reference voltage; and a voltage regulator 222 that steps down externally supplied voltage Vcc of 3.3V, 2.5V, or the like to generate power supply voltage Vdd of 1.5V or the like for the internal logic circuit. Reference numeral 223 denotes a liquid crystal drive level generator circuit that generates voltage required for driving the liquid crystal display panel based on externally supplied voltage DDVDH, VGH, VGL, or the like.

In addition, the liquid crystal control driver is provided with: a gradation voltage generator circuit 224 that generates gradation voltage required for generating waveform signals suitable for color display or gradation display; a γ adjustment circuit 225 that sets gradation voltage to the γ characteristic of the liquid crystal display panel: a gate line drive circuit 226 that applies voltage of selection level or non-selection level to the gate lines of the liquid crystal display panel; and a scan data generator circuit 227 that generates scan data for sequentially selecting gate lines.

Further, the liquid crystal control driver is provided with: a displayed data latch circuit 231 that holds displayed data read from the graphic RAM 206 for display on the liquid crystal display panel; and an M data converter circuit 232 that converts displayed data read out to the latch circuit 231 into data for alternating-current driving in which deterioration in liquid crystal is prevented. Further, it is provided with: a latch circuit 233 that holds data converted by the M data converter circuit 232; and a source line drive circuit (gradation voltage selection circuit and driver) 234 that selects a voltage corresponding to displayed data from among gradation voltages supplied from the gradation voltage generator circuit 224, and outputs voltages S1 to S384 to be applied to the source lines of the liquid crystal display panel.

Figure 8:
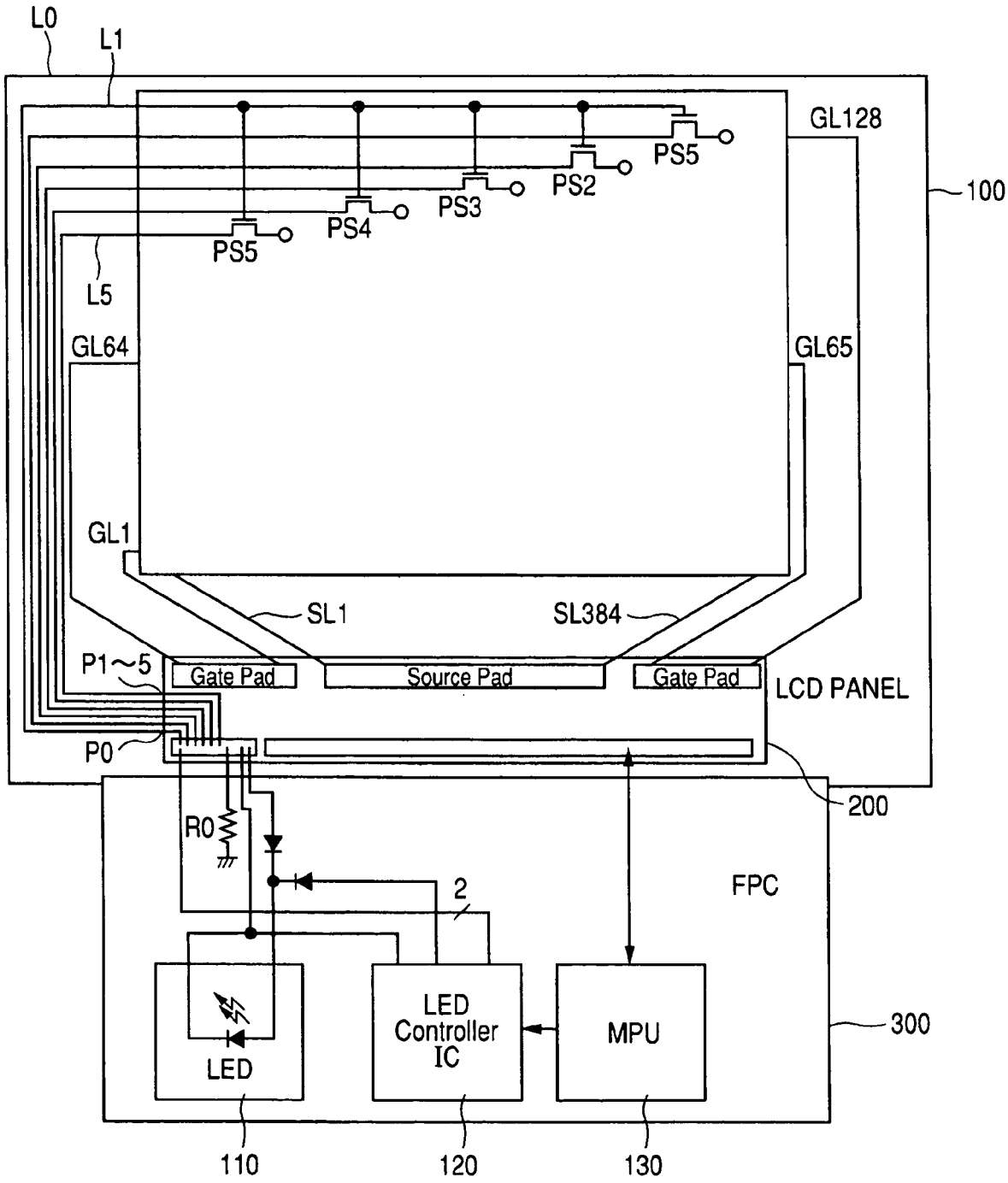
FIG. 8 is a block diagram illustrating the overall configuration of a liquid crystal display unit to which the liquid crystal control driver in FIG. 7 is applied.

FIG. 8 is a block diagram illustrating the overall configuration of a liquid crystal display unit to which the liquid crystal control driver in FIG. 7 is applied. In FIG. 8, the same circuits and elements as shown in FIG. 1 or FIG. 7 will be marked with the same reference numerals and codes, and duplicate description will be omitted.

In the liquid crystal display unit in this embodiment, a liquid crystal control driver 200 as a liquid-crystal-display control drive device is mounted face-down over one glass substrate of a liquid crystal display panel 100 by COG (Chip on Glass) technology. At the same time, on one side (lower side in the drawing) of the liquid crystal display panel 100, there is joined an FPC (Flexible Printed Circuit board) 300 mounted with the light emitting diode 110 as a backlight, backlight controller IC 120, microprocessor (MPU) 130, and the like illustrated in FIG. 1.

In the liquid crystal display unit in this embodiment, light detecting elements (MOS sensors) PS1 to PS5 as optical sensors composed of MOSFETs are formed over one glass substrate of the liquid crystal display panel 100. The drain terminals of these light detecting elements PS1 to PS5 and the predetermined terminals P1 to P5 of the liquid crystal control driver 200 are electrically connected with each other through wiring patterns L1 to L5 formed over the glass substrates of the liquid crystal display panel 100; their gate terminals and a predetermined terminal P0 are electrically connected with each other through a wiring pattern L0.

The above-mentioned liquid crystal display panel 100 is a dot matrix-type amorphous polysilicon TFT liquid crystal display panel in which display pixels are arranged in a matrix pattern, and each pixel is composed of three dots in red, blue, and green. Each pixel is provided with a pixel electrode and a switch element composed of TFT (Thin Film Transistor) that charges and discharges the pixel electrode. The sources of the switch elements of the pixels on one and the same column are connected to a common source line for transmitting image signals; and the gates of the switch elements of the pixels on one and the same row are connected to a common gate line for transmitting the pixel selection level.

These source lines and gate lines and the output terminals of the corresponding drive circuits 234 and 226 in the liquid crystal controller driver 200 are electrically connected with each other through the wiring patterns SL1 to SL384 and GL1 to GL128 formed over the glass substrates of the liquid crystal display panel 100. Each gate line is brought to selection level by the gate line drive circuit 226 once per frame period, and the switch elements of the pixels on one and the same row connected to a gate line at selection level are turned on. An image signal is transmitted to each pixel through a source line driven by the source drive circuit 234, and a picture electrode is charged with electric charges corresponding to an image signal through a pixel switch element in on state.

The liquid crystal display unit in this embodiment operates as follows. When it is determined by the light control circuit incorporated in the liquid crystal control driver 200 that the surrounding light intensity is in the darkest range B4 in FIG. 5, the following operation is performed: a weak current of several hundreds of microamperes is caused to flow from the liquid crystal control driver 200 to the light emitting diode 110, which emits light with a low brightness. When it is determined that the surrounding light intensity is in the second darkest range B3 in FIG. 5, the following operation is performed: the flow of current from the liquid crystal control driver 200 to the light emitting diode 110 is interrupted; a signal or code indicating the detected light intensity, outputted from the light control circuit, is supplied to the MPU 130. Then, a command is issued from the MPU 130 to the backlight controller IC 120, and the backlight controller IC 120 passes a current larger than the above weak current through the light emitting diode 110 according to the command and causes it to emit light with a slightly higher brightness.

When it is determined that the surrounding light intensity is in the second lightest range B2 in FIG. 5, the following operation is performed: the flow of current from the liquid crystal control driver 200 to the light emitting diode 110 is interrupted; a relatively large current of a dozen or so milliamperes is passed through the light emitting diode 110 by the backlight controller IC 120, and it emits light with a high brightness. When it is determined that the surrounding light intensity is in the lightest range in FIG. 5, the following operation is performed: the flow of current from the liquid crystal control driver 200 to the light emitting diode 110 is interrupted and further the current from the backlight controller IC 120 is interrupted, and the light emitting diode 110 does not emit light any more.

The liquid crystal display unit may be so constructed that the following is implemented: a signal indicating a detected light intensity, outputted from the light control circuit, is supplied directly to the backlight controller IC 120; the backlight controller IC 120 passes a current having a predetermined magnitude through the light emitting diode 110 according to the signal, and thus the brightness of emitted light is controlled without the intervention of the MPU.

Figure 9:
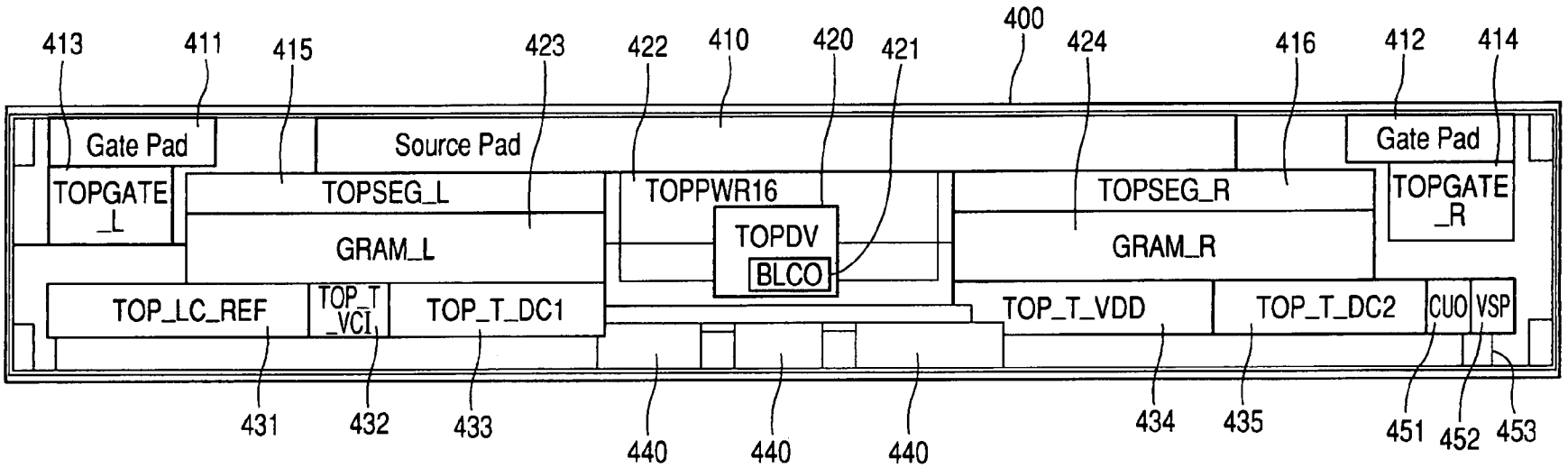
FIG. 9 is a plan view illustrating an example of the composition of layout of a liquid crystal control driver 200 that incorporates the backlight control circuit illustrated in FIG. 7.

FIG. 9 illustrates an example of the composition of layout of a liquid crystal control driver 200 that incorporates the backlight control circuit for a liquid crystal display panel, illustrated in FIG. 7.

In the liquid crystal control driver 200 in this embodiment, as illustrated in FIG. 9, there is provided a source pad formation portion 410 for outputting source line driving signals. The source pad formation portion is formed in the center of a chip 400 along one side (upper side in the drawing) of the chip in the direction of the length. On both sides of the source pad formation portion, there are provided gate pad formation portions 411 and 412 for outputting gate line driving signals. In proximity to the gate pad formation portions 411 and 412, there are formed gate drive system circuit formation portions 413 and 414 where the gate line drive circuit 226, the scan data generator circuit 227, and the like are formed.

In the center of the chip, there is formed a logic circuit formation portion 420 for the control circuit 210 and the like. A formation portion 421 for the timing generator circuit 202 is provided in the logic circuit formation portion, and a formation portion 422 for the amplifier for generating gradation voltage to be applied to source lines is provided around the logic circuit formation portion. On both sides of the amplifier formation portion 422, there are provided source drive system circuit formation portions 415 and 416 where the source line drive circuit 234 and the like are formed and memory formation portions 423 and 424 where the graphic RAM 206 is formed.

On the other side (lower side in the drawing) of the chip 400 in the direction of the length, there are provided a constant-voltage circuit formation portion 431 where a constant-voltage circuit such as the reference voltage generator circuit 221 is formed, a formation portion 432 for amplifier for the power supply regulator 222 and the like, and a formation portion 433 for a booster circuit of medium breakdown voltage that generates power supply voltage for the source line drive circuit 234 and the like. Further, there are provided an I/O formation portion 440 for the interface 203 and the like, a formation portion 434 for a constant-voltage circuit of low breakdown voltage that generates power supply voltage (1.5V) for internal logic circuits, and a formation portion 435 for a booster circuit of high breakdown voltage that generates power supply voltage for the gate line drive circuit 226. In proximity to the formation portion 435 for a booster circuit, there are provided a formation portion 451 for the current source circuit 48 that constructs the light control circuit 40 in the above embodiment, and a formation portion 452 for other circuits (integrator circuit 41, comparator CMP, shift registers 44, majority decision circuits 45, encoder 46, etc.).

In proximity to the formation portions 451 and 452 for the light control circuit 40, there are provided a formation portion 453 for pads as the terminals P1 to P5 to which optical sensors are connected, the output terminal P0 for sensor activation voltage VPSONVCI to be applied to gates, and external terminals P8 to P11 for the backlight. As mentioned above, the formation portions 451 and 452 for the light control circuit 40 and the formation portion 453 for pads as the terminals P1 to P5 and P0 are provided in proximity to each other. This enhances the accuracy of sampling values obtained by the integrator circuit 41. There is not a circuit that makes a source of high-frequency signals or wiring that transmits high-frequency signals in proximity to the formation portion 451 or 452 for the light control circuit 40. Therefore, malfunction of the light control circuit 40 and the superposition of noise on the output signals of the light control circuit 40 can be avoided.

Up to this point, concrete description has/been given to the invention made by the present inventors based on embodiments. However, the invention is not limited to the above-mentioned embodiments, and can be variously modified without departing from the scope of the invention, needless to add. Some examples will be taken. The description of the liquid crystal display unit in the above embodiments takes as examples cases where MOS sensors are formed over a substrate of a liquid crystal display panel. The invention can be applied to cases where an independent sensor is placed in proximity to a liquid crystal display panel and a backlight is controlled based on its detection signal.

The description of the above embodiments takes as examples cases where an MOS sensor is used for the optical sensor. Instead, a light detecting element such as CCD (Charge Coupled Device) may be used. In cases where a voltage output-type element is used for the light detecting element; voltage-current conversion circuit is provided in the stage preceding the integrator circuit in the embodiments. Thus, the above embodiments can be applied without any other change. The following circuitry is also possible: a voltage input-type amplifier circuit is used in place of the integrator circuit, and the comparator CMP and the subsequent circuits in FIG. 1 are connected to the stage subsequent to the amplifier circuit.

The above description has bee given mainly to cases where the invention made by the present inventors is applied to a backlight control device for a liquid crystal display panel in the field of utilization underlying the invention. However, the invention is not limited to this construction. The invention can be applied to, for example, a device for controlling a lamp of the display section of various measuring instruments or the like.

What is claimed is:

1. A light control circuit for a display control drive device on a semiconductor substrate, the light control circuit comprising:

a plurality of input terminals adapted to be coupled to a plurality of optical sensors;

a common sampling circuit that samples the outputs of the optical sensors inputted through the input terminals;

a level determination circuit that determines levels of voltages sampled by the sampling circuit;

an output terminal through which a result of said determination by the level determination circuit is outputted; and an input selecting circuit provided between the input terminals and the sampling circuit, wherein the sampling circuit samples the outputs of the optical sensors sequentially inputted through the input terminals in a temporally dispersed manner by the input selecting circuit, and wherein the level determination circuit includes a plurality of registers constructed to hold a plurality of discrimination results corresponding to the levels of the voltages in chronological order so that discrimination results for one said optical sensor are stored consecutively into each said register;

a plurality of majority decision determination circuits coupled to the plurality of registers and configured to determine a majority of the discrimination results based on values held in the plurality of registers and to output a result of majority determination; and an encoder configured to encode the result of the majority determination and to output the result of encoding as a result of the determination to control a brightness of a backlight for a display panel.

2. A light control circuit for a display control drive device on a semiconductor substrate, the light control circuit comprising:

a plurality of input terminals adapted to be coupled to a plurality of optical sensors;

a common integrator circuit that integrates currents inputted through the input terminals to sample voltages corresponding to outputs of the optical sensors;

a level determination circuit that determines levels of voltages sampled by the integrator circuit;

an output terminal through which a result of said determination by the level determination circuit is outputted; and an input selecting circuit provided between the input terminals and the integrator circuit and configured to input a current inputted through any of said input terminals to the integrator circuit, wherein the integrator circuit integrates currents sequentially inputted through the input terminals in a temporally dispersed manner by the input selecting circuit, and wherein the level determination circuit includes a comparator to which is inputted the voltages sampled by the integrator circuit and a predetermined reference voltage;

a plurality of shift registers constructed to receive and hold three or more outputs of the comparator in chronological order so that discrimination results for one said optical sensor are stored consecutively into each said register;

a plurality of majority decision determination circuits configured to determine a majority of the discrimination results based on values held in the shift registers; and an encoder configured to encode outputs of the majority decision determination circuits and to output the result of encoding as a result of the determination to control a brightness of a light-emitting device for a backlight of a display panel.

3. The light control circuit of claim 2, wherein the level determination circuit includes:

a resistance type voltage divider circuit that generates the reference voltage; and registers that hold a plurality of set values corresponding to the threshold voltages, and that supply any of the set values held in the registers to the resistance type voltage divider circuit and thereby inputs the predetermined reference voltage to the comparator.

4. The light control circuit of claim 2, further comprising:

a current source circuit that passes a predetermined current; and a first external terminal through which a current passed by the current source circuit is outputted, wherein the current source circuit is constructed to output or interrupt the predetermined current to the first external terminal according to the result of the determination by the encoder.

5. The light control circuit of claim 4, further comprising:

a second external terminal to which the light-emitting device such that the light-emitting device is coupled between the first external terminal and the second external terminal;

a third external terminal to which a constant potential is externally applied; and a switch element provided between the second external terminal and the third external terminal, wherein the switch element is kept on while the current source circuit passes a constant current according to the result of determination by the encoder.

6. A liquid-crystal-display control drive device on a semiconductor substrate, the liquid-crystal-display control drive device comprising:

a light control circuit that includes a plurality of input terminals adapted to be coupled to a plurality of optical sensors, a common integrator circuit that integrates currents inputted through the input terminals to sample voltages corresponding to outputs of the optical sensors, the integrator circuit being constructed to integrate currents sequentially inputted through the input terminals in a time division manner, a level determination circuit that determines levels of voltages sampled by the integrator circuit, and an output terminal through which a result of determination by the level determination circuit is outputted, and a selecting circuit that is provided between the input terminals and the integrator circuit and that inputs a current inputted through any input terminal to the integrator circuit, wherein the level determination circuit includes a comparator to which is inputted the voltages sampled by the integrator circuit and a predetermined reference voltage;

a plurality of shift registers constructed to receive and hold three or more outputs of the comparator in chronological order so that discrimination results for one said optical sensor are stored consecutively into each said register;

a plurality of majority decision determination circuits configured to determine a majority of the discrimination results based on values held in the shift registers; and an encoder configured to encode outputs of the majority decision determination circuits and to output the result of encoding as a result of the determination to control a brightness of a light-emitting device for a backlight of a display panel;

a first drive circuit that outputs a driving signal applied to a scanning line of a liquid crystal display panel;

a display memory that stores displayed data displayed on the liquid crystal display panel; and a second drive circuit that outputs a driving signal applied to a signal line of the liquid crystal display panel according to displayed data read from the display memory, the liquid-crystal-display control drive device being formed over a single semiconductor substrate.

7. The liquid-crystal-display control drive device of claim 6, wherein the common integrator circuit performs the integrating operation during a display blank period within a frame period that is a scanning period for one screen page in the liquid crystal display panel.

8. The liquid-crystal-display control drive device of claim 7, wherein the common integrator circuit performs a plurality of times the integrating operation during one display blank period, and the level determination circuit discriminates the levels of a plurality of voltages sampled by a plurality of times of the integrating operation by the integrator circuit during one display blank period, using a plurality of threshold voltages, and holds a plurality of discrimination results across a plurality of frames in chronological order, determines the majority of the discrimination results, and outputs the result of majority determination as a result of the determination.

9. The liquid-crystal-display control drive device of claim 6, wherein the level determination circuit includes:

a resistance type voltage divider circuit that generates the reference voltage; and registers that hold a plurality of set values corresponding to the threshold voltages, and that supply any of the set values held in the registers to the resistance type voltage divider circuit and thereby inputs the predetermined reference voltage to the comparator.

10. The liquid-crystal-display control drive device of claim 6, further comprising:

a current source circuit that passes a predetermined current; and a first external terminal through which a current passed by the current source circuit is outputted, wherein the current source circuit is constructed to output or interrupt the predetermined current to the first external terminal according to the result of the determination by the encoder.

11. The liquid-crystal-display control drive device of claim 10, further comprising:

a second external terminal to which the light-emitting device such that the light-emitting device is coupled between the first external terminal and the second external terminal;

a third external terminal to which a constant potential is externally applied; and a switch element provided between the second external terminal and the third external terminal, wherein the switch element is kept on while the current source circuit passes a constant current according to the result of determination by the encoder.

* * * * *